US012540374B2

(12) United States Patent
Kirihara et al.

(10) Patent No.: US 12,540,374 B2
(45) Date of Patent: Feb. 3, 2026

(54) NICKEL ALLOY HAVING SUPERIOR SURFACE PROPERTIES AND PRODUCTION METHOD FOR THE SAME

(71) Applicant: Nippon Yakin Kogyo Co., Ltd., Tokyo (JP)

(72) Inventors: Fumiaki Kirihara, Kawasaki (JP); Daiki Ogasawara, Kawasaki (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 365 days.

(21) Appl. No.: 18/035,139

(22) PCT Filed: Mar. 7, 2022

(86) PCT No.: PCT/JP2022/009725

§ 371 (c)(1),
(2) Date: May 3, 2023

(87) PCT Pub. No.: WO2023/062855

PCT Pub. Date: Apr. 20, 2023

(65) Prior Publication Data

US 2024/0011126 A1 Jan. 11, 2024

(30) Foreign Application Priority Data

Oct. 11, 2021 (JP) ..... 2021-166913

(51) Int. Cl.

| | |
|---|---|
| ***C22C 19/03*** | (2006.01) |
| ***C22B 9/10*** | (2006.01) |
| ***C22B 23/06*** | (2006.01) |
| ***C22F 1/10*** | (2006.01) |

(52) U.S. Cl.

CPC ..... *C22C 19/03* (2013.01); *C22B 9/10* (2013.01); *C22B 23/06* (2013.01); *C22F 1/10* (2013.01)

(58) Field of Classification Search

CPC ..... C22C 1/023; C22C 19/03

See application file for complete search history.

(56) References Cited

U.S. PATENT DOCUMENTS

| | | | |
|---|---|---|---|
| 2012/0217433 A1 | 8/2012 | Yokoyama et al. | |
| 2014/0023549 A1 | 1/2014 | Katsuki | |
| 2017/0283917 A1 | 10/2017 | Katsuki | |

FOREIGN PATENT DOCUMENTS

| | | | | |
|---|---|---|---|---|
| GB | 2212513 A | * | 7/1989 | ..... C22C 19/03 |
| JP | S63-168259 A | | 7/1988 | |
| JP | H08-143996 A | | 6/1996 | |
| JP | 2010-132934 A | | 6/2010 | |
| JP | 2010-159437 A | | 7/2010 | |
| JP | 2012-177140 A | | 9/2012 | |
| JP | 2012-201945 A | | 10/2012 | |

OTHER PUBLICATIONS

Bounds, A.M., & Briggs, T. H. (2007). Nickel alloys for oxide-coated cathodes. Proceedings of the IRE, 39(7), 788-799. (Year: 2007).*

Apr. 12, 2022 International Search Report issued in International Patent Application No. PCT/JP2022/009725.

* cited by examiner

*Primary Examiner* — Alexandra M Moore
(74) *Attorney, Agent, or Firm* — Oliff PLC

(57) ABSTRACT

A nickel alloy having superior surface properties by controlling the composition of non-metallic inclusions that affect surface properties, and a method for producing the same. A nickel alloy includes: all by mass %, Ni: 99.0% or more, C: 0.020% or less, Si: 0.01 to 0.3%, Mn: 0.3% or less, S: 0.010% or less, Cu: 0.2% or less, Al: 0.001 to 0.1%, Fe: 0.4% or less, O: 0.0001 to 0.0050% or less, Mg: 0.001 to 0.030%, Ca: 0.0001 to 0.0050%, B: 0.0001 to 0.01%, and the balance of inevitable impurities; the alloy including non-metallic inclusions, in which the non-metallic inclusions include one or more of MgO, CaO, CaO—$Al_2O_3$-based oxides, CaO—$SiO_2$-based oxides, CaO—MgO-based oxides, and $MgO{\cdot}Al_2O_3$, the $MgO{\cdot}Al_2O_3$ has a number ratio of number 50% or less with respect to all oxide-based, non-metallic inclusions.

5 Claims, No Drawings

NICKEL ALLOY HAVING SUPERIOR SURFACE PROPERTIES AND PRODUCTION METHOD FOR THE SAME

TECHNICAL FIELD

The present invention relates to nickel alloys containing 99 mass % or more of Ni and having superior surface properties, and to a smelting method for the same, and relates to a technique for producing nickel alloys and nickel alloy plates having superior surface properties by controlling slag composition and controlling elements in small quantities such as Mg, Ca, and O, thereby suppressing inhibiting generation of harmful $MgO \cdot Al_2O_3$ among non-metallic inclusions in melted nickel.

BACKGROUND ART

Since nickel alloys containing 99 mass % or more of Ni have superior corrosion resistance, and specifically, have greatly high resistance with respect to caustic alkali, they are used in caustic soda plant electrodes and containers, rechargeable secondary battery terminals, heat exchangers, and the like. Here, since nickel, which is the main component of the nickel alloy, is a very expensive metal compared to iron, it is very important to improve the yield to reduce the production cost. Here, since surface defects such as linear flaws on the surface of the nickel alloy greatly reduce yield, there is a demand for nickel alloys with superior surface properties.

Patent Document 1 proposes a method for producing high-quality pure nickel hot coils with few surface flaws by applying an antioxidant to a slab produced by continuous casting.

However, the additional step of applying the antioxidant and the cost of the antioxidant itself lead to an increase in cost. In addition, although non-metallic inclusions in nickel alloys affect the surface properties, no description was found regarding the composition of the inclusions.

Furthermore, Patent Document 2 proposes a technique for suppressing cracking in the slab producing stage, hot rolling stage, and the like by controlling Mg, Al, and Ti in nickel for electrical equipment.

However, since it is necessary to add expensive Ti, this leads to an increase in cost. In addition, cracks during slab producing stage and hot rolling are targeted, and surface defects caused by non-metallic inclusions are not targeted.

Patent Document 3 discloses a method for producing a nickel cold-coiled coil having high productivity and yield by cold-rolling a hot-rolled coil containing 3 to 100 ppm of boron.

However, the above technique suppresses problems caused by rolling wear debris during cold rolling, and does not target defects caused by non-metallic inclusions.

Patent Documents 4 and 5 disclose methods for producing Fe—Ni alloys and Fe—Cr—Ni alloys having superior surface quality by controlling the composition of non-metallic inclusions.

However, these relate to Fe-based alloys containing Fe as a main component. Although the composition of non-metallic inclusions is greatly affected by the components of the molten metal, even if the same element is used, the effect on the composition of non-metallic inclusions differs between the Fe-based alloy and the Ni-based alloy. The composition of the slag also has a great effect on the composition of non-metallic inclusions, in the refining of Fe—Ni alloys and Fe—Cr—Ni alloys, mixing of $Cr_2O_3$ and FeO into the slag is unavoidable.

Therefore, the techniques for controlling non-metallic inclusions in Patent Documents 4 and 5 cannot be applied to nickel alloys that do not contain Fe and Cr, which are the subject of the present invention. That is, it can be said that the problem of surface properties due to non-metallic inclusions in nickel alloys still remains.

The Patent documents are as follows.

Patent document 1: Japanese Unexamined Patent Application Publication No. S63-168259

Patent document 2: Japanese Unexamined Patent Application Publication No. H8-143996

Patent document 3: Japanese Unexamined Patent Application Publication No. 2010-132934

Patent document 4: Japanese Unexamined Patent Application Publication No. 2010-159437

Patent document 5: Japanese Unexamined Patent Application Publication No. 2012-201945

SUMMARY OF INVENTION

Problems Solved by the Invention

In view of the above problems, an object of the present invention is to control the composition of non-metallic inclusions that affect the surface properties and to produce nickel alloys having superior surface properties. Furthermore, the present invention also provides a production method for realizing this.

The inventors have made intensive studies to solve the above problems. First, the inventors studied surface defects generated in a nickel alloy plate containing 99 mass % or more of Ni. That is, a sample containing surface defects was taken, the cross section of the surface defects was observed with an SEM, and the composition of foreign matter contained inside was specified. As a result, it was found that the composition of the foreign matter was $MgO \cdot Al_2O_3$.

Furthermore, when they investigated the relationship with the operation, they found that this $MgO \cdot Al_2O_3$ originated from non-metallic inclusions contained in the molten metal, and deposited on the nozzle that supplies molten metal from a tundish to the mold in the continuous casting machine, and part of it falls off, thereby causing large surface defects. In order to prevent this, they have obtained a guidance that $MgO \cdot Al_2O_3$ inclusions should be prevented by controlling the basicity of the slag and elements in small quantities such as Mg, Ca, and O.

Next, the inventors have made intensive studies on the relationship between the composition of inclusions and the metal components nickel alloys. Specifically, in the producing process of a nickel alloy containing 99 mass % or more of Ni, a metal sample of the nickel alloy was taken from the tundish, 20 inclusions exceeding 20 lam were randomly selected in the sample and the composition of inclusions were measured by SEM/EDS, and they extensively studied the relationships between the composition of inclusions and metal components. As a result, while controlling the Si concentration of 0.01 to 0.3 mass % and the Al concentration of 0.001 to 0.1 mass %, by adjusting the Mg concentration of 0.001 to 0.030 mass %, the Ca concentration of 0.0001 to 0.0050 mass %, and the O concentration of 0.0001 to 0.0050 mass %, they found that the composition of inclusions can basically be controlled to MgO or CaO—$SiO_2$-based oxides or CaO—$Al_2O_3$-based oxides and completed the present invention based on the knowledge obtained by the above analysis.

The present invention is a nickel alloy consisting of, all in mass %, Ni: 99.0% or more, C: 0.020% or less, Si: 0.01 to 0.3%, Mn: 0.3% or less, S: % or less, Cu: 0.2% or less, Al: 0.001 to 0.1%, Fe: 0.4% or less, O: 0.0001 to 0.0050% or less, Mg: 0.001 to 0.030%, Ca: 0.0001 to 0.0050%, B: 0.0001 to %, and balance of inevitable impurities; the alloy comprising non-metallic inclusions, wherein the non-metallic inclusions comprise one or more of MgO, CaO, CaO—$Al_2O_3$-based oxides, CaO—$SiO_2$-based oxides, CaO—MgO-based oxides, $MgO{\cdot}Al_2O_3$, the $MgO{\cdot}Al_2O_3$ has a number ratio of number 50% or less with respect to all oxide-based non-metallic inclusions.

The alloy may further comprises 0.05 mass % or less of Ti and 0.005 mass % or less of N.

In the non-metallic inclusions, the $MgO{\cdot}Al_2O_3$ may include 10 to 40 mass % of MgO and 60 to 90 mass % of $Al_2O_3$, the CaO—$Al_2O_3$-based oxides may include 30 to 70 mass % of CaO and 30 to 70 mass % of $Al_2O_3$, the CaO—$SiO_2$-based oxides may include 30 to 70 mass % of CaO and 30 to 70 mass % of $SiO_2$, and the CaO—MgO-based oxides may include 20 to 80 mass % of CaO and 20 to 80 mass % of MgO.

In the non-metallic inclusions, the number ratio of the total number of the CaO and the CaO-based oxides is preferably number 75% or less.

The present invention also provides a production method for the nickel alloy. The method comprising: melting a raw material in an electric furnace, then decarburizing in an electric furnace, AOD and/or VOD, charging lime, fluorite, Si and/or Al, deoxidizing and desulfurizing while stirring using CaO—$SiO_2$—$Al_2O_3$—MgO—F based slag consisting of CaO: 35 to 70 mass %, $SiO_2$: 3 to mass %, MgO: 5 to 30 mass %, $Al_2O_3$: 1 to 25 mass %, and balance of Fe and inevitable impurities, after adjusting the temperature and composition while promoting the floating of inclusions by Ar stirring in LF, producing a slab or ingot by a continuous casting machine or ordinary ingot casting, hot forging the ingot, thereby producing a slab, and continuously hot rolling and cold rolling, thereby obtaining a nickel alloy or nickel alloy plate.

MODE FOR CARRYING OUT THE INVENTION

Next, reasons for limiting the composition of each element in the present invention will be described.

Ni: 99.0 Mass % or More

Since it is a main component of the nickel alloy and is indispensable for exhibiting caustic soda resistance, the lower limit is set to be 99.0 mass %. It is preferably 99.1 mass % or more, and more preferably 99.2 mass % or more.

C: 0.020 Mass % or Less

Since C precipitates at grain boundaries as graphite in the temperature range of 430 to 650° C. and causes embrittlement, the content is set to be 0.020 mass % or less. It is preferably 0.018 or less, more preferably 0.015 mass % or less.

Si: 0.01 to 0.3 Mass %

Si is an element effective for deoxidation. If the content of Si is less than 0.01 mass %, a sufficient deoxidizing effect cannot be obtained. On the other hand, if the Si content exceeds 0.3 mass %, it becomes difficult to ensure Ni: 99.0 mass % or more, and further MgO and CaO in the slag are reduced to provide excessive Mg and Ca in the molten metal and it causes surface defects. Therefore, in the present invention, the content of Si is set in the range of 0.01 to 0.3 mass %. Within this range, it is preferably 0.02 to 0.25 mass %. More preferably, it is 0.03 to 0.20 mass %.

Mn: 0.3 Mass % or Less

Mn, like Si, is an element effective for deoxidation. However, if it exceeds 0.3 mass %, it becomes difficult to satisfy Ni: 99.0 mass % or more, and excessive supply adversely affects the surface quality. Therefore, in the present invention, the content of Mn is set to be 0.3 mass % or less. Preferably, it is 0.28 mass % or less. More preferably, it is 0.25 mass % or less.

S: 0.010 Mass % or Less

S segregates at grain boundaries, deteriorates hot workability, and causes cracking during hot rolling, so it is desirable that the concentration be as low as possible. Therefore, the content of S is set to be 0.010 mass % or less. Preferably, it is 0.005 mass % or less. More preferably, it is 0.002 mass % or less.

Cu: 0.2 Mass % or Less

Cu achieves N: 99.0 mass % or more, and furthermore, in order to ensure corrosion resistance, it is desirable to reduce it as much as possible. Therefore, the content of Cu is set to be 0.2 mass % or less. Preferably, it is 0.10 mass % or less. More preferably, it is 0.05 mass % or less.

Al: 0.001 to 0.1 Mass %

Al is a deoxidizing element and an important component in the present invention. If the content of Al is less than 0.001 mass %, deoxidation does not work sufficiently, the O concentration exceeds 0.0050 mass %, and the number of oxide-based inclusions increases, thereby causing surface defects. On the other hand, if it is 0.1 mass % or more, it becomes difficult to ensure Ni: 99.0 mass % or more, and excessive deoxidation occurs, and the capacity to reduce MgO and CaO in the slag becomes too high, thereby supplying excessive Mg and Ca in the molten metal. As a result, the composition of inclusions is mainly composed of CaO, CaO—MgO-based oxides, and $MgO{\cdot}Al_2O_3$, which adversely affect the surface quality. Therefore, the Al content is set to the range of 0.001 to 0.08 mass %. Preferably, it is 0.002 to 0.09 mass %. More preferably, it is 0.003 to 0.08 mass %.

Fe: 0.4 Mass % or Less

Fe is a component that is unavoidably mixed, and it is an impurity in the nickel alloy, and it is desirable that the content be as low as possible. Therefore, it is set to be 0.4 mass % or less. Preferably, it is 0.002 to 0.09 mass %. More preferably, it is 0.003 to 0.08 mass %. Preferably, it is 0.35 mass % or less. More preferably, it is 0.30 mass % or less.

Mg: 0.001 to 0.030 Mass %

Mg is an effective element for controlling the composition of non-metallic inclusions in the nickel alloy to MgO, which is an oxide that does not adversely affect the surface properties. Furthermore, S is fixed as MgS, thereby improving hot workability. The effect cannot be obtained when the content is less than 0.001 mass %. On the other hand, if the content exceeds 0.030 mass %, it becomes excessive, and it leads to deterioration of hot workability and deterioration of surface quality due to CaO—MgO inclusions. Therefore, the Mg content is set to the range of 0.001 to 0.030 mass %. Preferably, it is 0.002 to 0.025 mass %. More preferably, it is 0.003 to 0.020 mass %.

Ca: 0.0001 to 0.0050 Mass %

Ca is an effective element for controlling the composition of non-metallic inclusion in the nickel alloy to CaO—$Al_2O_3$-based oxides that do not form clusters and do not adversely affect the surface quality. The effect cannot be obtained when the content is less than 0.0001 mass %. On the other hand, when the content exceeds 0.0050 mass %, most of the inclusions become inclusions of CaO alone. Although CaO inclusions do not form clusters, they react with water as shown in formula (1) to form hydrates and adversely affect the surface quality.

$$CaO+H_2O \rightarrow Ca(OH)_2 \quad (1)$$

Therefore, the Ca content is set to the range of 0.0001 to 0.0050 mass %. Preferably, it is 0.0002 to 0.0030 mass %. More preferably, it is 0.0003 to 0.0020 mass %.

O: 0.0001 to 0.0050 Mass %

When O is present in the nickel alloy, in excess of 0.0050 mass %, the amount of inclusions increases and the amount of inclusions that adversely affect the surface properties increases. Furthermore, desulfurization is inhibited, and the S concentration in the molten metal exceeds 0.010 mass %. Conversely, if it is as low as less than 0.0001 mass %, Al increases the capacity to reduce MgO and CaO in the slag too much, and the contents of Mg and Ca in the molten metal become higher than 0.030 mass % and 0.0050 mass %, respectively. Therefore, the 0 content is set to the range of 0.0001 to 0.0050 mass %. Preferably, it is 0.0002 to 0.0040 mass %. More preferably, it is 0.0003 to 0.0030 mass %.

B: 0.0001 to 0.01 Mass %

B is a component that improves hot workability. If it is less than 0.0001 mass %, the effect is not exhibited, and conversely, if it exceeds 0.01 mass %, it forms a boron compound (boride), which may cause deterioration of corrosion resistance and workability. Therefore, it is set to the range of 0.0001 to 0.01 mass %. Preferably, it is 0.0003 to 0.008 mass %. More preferably, it is 0.0005 to 0.005 mass %.

Furthermore, the nickel alloy in the present invention may contain the following elements.

Ti: 0.05 Mass % or Less

Ti is a deoxidizing component and an element that has a high affinity for N. If the amount is very small, it has the effect of fixing the N gas presenting in the nickel alloy and suppressing the expansion of voids inside the slab and the surface due to bubbles. However, when the content exceeds 0.05 mass %, TiN is excessively generated and deteriorates the surface properties. Furthermore, it becomes difficult to ensure Ni: 99.0 mass % or more. Therefore, the content is set to be 0.05 mass % or less. Preferably, it is 0.04 mass % or less. More preferably, it is 0.03 mass % or less. In addition, since Ti is an element that tends to be unavoidably mixed from the raw material, and it is important to select the raw material so as not to mix Ti to satisfy the composition range.

N: 0.005 Mass % or Less

N is an element that is unavoidably mixed in from the atmosphere, and forms nitrides with various elements, deteriorating surface properties. Therefore, it is an element that must be reduced as much as possible. Therefore, in the present invention, the content is set to be 0.005 mass % or less. Preferably, it is mass % or less. More preferably, it is 0.002 mass % or less.

Non-Metallic Inclusions

In the present invention, one or more of MgO, CaO, CaO—$Al_2O_3$-based oxide, CaO—$SiO_2$-based oxide, CaO—MgO-based oxide, and MgO·$Al_2O_3$ are included. A preferable mode is that the number ratio of the MgO·$Al_2O_3$ is number % or less with respect to all oxides-based non-metallic inclusions. The grounds for limiting the number ratio of non-metallic inclusions are shown below.

One or more of MgO, CaO, CaO—$Al_2O_3$-based oxide, CaO—$SiO_2$-based oxide, CaO—MgO-based oxide, and MgO·$Al_2O_3$ are included, and the number ratio of the MgO·$Al_2O_3$ is number 50% or less In the nickel alloy of the present invention, according to the content of Si, Al, Mg, and Ca, one or more of MgO, CaO, CaO—$Al_2O_3$-based oxides, CaO—$SiO_2$-based oxides, CaO—MgO-based oxides, and MgO·$Al_2O_3$ are included. It should be noted that among the above indicating method of the composition of non-metallic inclusions, those indicated by connecting with a "-" indicate that the inclusion species are in a solid solution at a temperature of 1600° C. of the refining temperature of the nickel alloy, and those indicated by connecting with a "·" indicating that the inclusion species form an intermediate compound at a temperature of 1600° C. of the refining temperature of the nickel alloy. Regarding CaO—MgO-based oxides, on the CaO—MgO binary system phase diagram, although it is a eutectic composition of CaO and MgO at a temperature of 1600° C., in CaO—MgO-based oxides, since CaO and MgO are finely dispersed in a wide range of the components, it is described with a "-" representing a solid solution. Among them, MgO has a high melting point and does not deposit on the nozzle, and it thereby does not increase in size. Furthermore, since it is hard, it does not elongate during the rolling process and thus does not form surface defects. CaO also has a high melting point and does not deposit on the nozzle, and it thereby does not increase in size. Furthermore, since it is hard, it does not elongate during the rolling process and surface defects are less likely to occur. Although CaO—$Al_2O_3$-based oxides and CaO—$SiO_2$-based oxides have low melting points and are elongated in the rolling process, they do not form surface defects due to their small original size and fine dispersion.

Since MgO·$Al_2O_3$ is an inclusion that causes surface defects, its content should be as low as possible. However, if the content is number 50% or less in number ratio, the number of surface defects can be reduced. Therefore, the number ratio of MgO·$Al_2O_3$ is set to be number 50% or less. Preferably, it is number 40% or less. More preferably, it is number 30% or less.

The Total Number Ratio of CaO and CaO—MgO-Based Oxides is Number % or Less

CaO is an inclusion that has a high melting point, does not deposit to the nozzle, and does not enlarge. However, since it is an inclusion that reacts with moisture in the atmosphere to form a hydrate and drops off from the surface, it thereby causes pits. Therefore, if it presents in excess, there is a risk of affecting the surface properties. CaO—MgO-based oxides are inclusions in which a CaO phase and an MgO phase are mixed in one inclusion. CaO—MgO-based oxides are likely to become a hydrate similarly to CaO inclusions, drop off from the surface, and form pits. Therefore, the total number ratio of CaO and CaO—MgO-based oxides is set to be number 75% or less. Preferably, it is number % or less. More preferably, it is number 50% or less.

The reason for specifying the constituent components of MgO·$Al_2O_3$ will be explained.

MgO·$Al_2O_3$ is Consisting of MgO: 10 to 40 Mass % and $Al_2O_3$: 60 to 90 Mass %

MgO·$Al_2O_3$ is a compound having a relatively wide solid solution range. Since it becomes a solid solution in the above range, it is specified in the above composition.

The reason for specifying each component of CaO—$Al_2O_3$-based oxides will be explained.

CaO: 30 to 70 Mass % and $Al_2O_3$: 30 to 70 Mass %

Basically, the above range is set to keep the melting point of the CaO—$Al_2O_3$-based oxides at a temperature of about 1300° C. or less. If the CaO content exceeds 70 mass %, CaO inclusions coexist, and if the $Al_2O_3$ content exceeds 70 mass %, harmful $Al_2O_3$ inclusions that cause flaws coexist. From the above, the CaO content is set to the range of 30 to 70 mass % and the $Al_2O_3$ content is set to the range of 30 to 70 mass %. Furthermore, the CaO—$Al_2O_3$-based oxides may contain 10 mass % or less of Si2 and 15 mass % or less of MgO. This is because the CaO—$Al_2O_3$-based oxides, even if it contains 10 mass % of $SiO_2$ and 15 mass % of MgO, elongate during the rolling process, but its original size is small and finely dispersed, whereby surface defects are not caused.

The reason for specifying each component of the CaO—$SiO_2$-based oxides will be explained.

CaO: 30 to 70 Mass % and $SiO_2$: 30 to 70 Mass %

Basically, the above range is set to keep the melting point of the CaO—$SiO_2$-based oxides at a temperature of about 1300° C. or less. When the CaO content is less than 30 mass %, the melting point becomes high, and when the CaO content exceeds 70 mass %, CaO inclusions coexist. If the $SiO_2$ content is less than 30 mass % and more than 70 mass %, the melting point becomes high. From the above, the CaO content is set in the range of 30 to 70 mass % and the $SiO_2$ content is set in the range of 30 to 70 mass %. Furthermore, the CaO—SiO32-based oxides may contain $Al_2O_3$ at 10 mass % or less and MgO at 15 mass % or less. This is because the CaO—$SiO_2$-based oxides, even if it contains 10 mass % of $Al_2O_3$ and 15 mass % of MgO, elongate during the rolling process, but its original size is small and finely dispersed, whereby surface defects are not caused.

Furthermore, the reason for specifying each component of the CaO—MgO-based oxides will be explained.

CaO: 20 to 80 Mass % and MgO: 20 to 80 Mass %

The concentrations of CaO and MgO in the CaO—MgO-based oxides correspond to the phase ratio of CaO and MgO in the CaO—MgO-based oxides. If the CaO content is greater than 80 mass %, the CaO phase has a large effect and behaves similarly to the CaO inclusions, and if the MgO content is greater than 80 mass %, the MgO phase has a large effect and behaves similarly to the MgO inclusions. Therefore, the CaO content is set in the range of 20 to 80 mass %, and the MgO content is set in the range of 20 to 80 mass %.

Production Method

The present invention also provides a production method for nickel alloy. First, melting a raw material in an electric furnace, then decarburizing in an electric furnace, AOD and/or VOD, charging lime, fluorite, Si and/or Al, deoxidizing and desulfurizing while stirring using CaO—$SiO_2$—$Al_2O_3$—MgO—F based slag consisting of CaO: 35 to 70 mass %, $SiO_2$: 3 to 25 mass %, MgO: 5 to 30 mass %, $Al_2O_3$: 1 to 25 mass %, after adjusting the temperature and composition while promoting the floating of inclusions by Ar stirring in LF, producing a slab or ingot by a continuous casting machine or ordinary ingot casting. The ingot is subjected to hot forging, thereby producing a slab. Thus, a nickel alloy in which non-metallic inclusions comprise one or more of MgO, CaO, CaO—$Al_2O_3$-based oxides, CaO—$SiO_2$-based oxides, CaO—MgO-based oxides, MgO·$Al_2O_3$, wherein the MgO·$Al_2O_3$ has a number ratio of number 50% or less with respect to all oxide-based non-metallic inclusions can be obtained. The yielded slab is subjected to surface grinding, hot rolling at a temperature of 1050° C. to a predetermined thickness, annealing, pickling to remove scale on the surface, thereby finally producing a plate having a predetermined thickness.

The production method according to the present invention has a specific feature in the composition of the slag. The reasons for specifying the slag composition in the present invention will be explained below.

CaO: 35 to 70 Mass %

The CaO concentration in the slag is an important element for efficient deoxidation and desulfurization and inclusion control. The concentration is adjusted by adding lime. When the CaO concentration exceeds 70 mass %, the activity of CaO in the slag increases, the concentration of Ca reduced in the molten metal exceeds 0.0050 mass %, and a large amount of non-metallic inclusions of CaO alone are generated, in the final product, it becomes a hydrate and may cause pits. Therefore, the upper limit is set to be 70 mass %. On the other hand, if the CaO concentration is less than 35 mass %, deoxidation and desulfurization do not proceed, and the S concentration and the O concentration cannot be controlled within the ranges of the present invention. Therefore, the lower limit is set to be mass %. Therefore, the CaO concentration is set in the range of 35 to 70 mass %. Preferably, it is 40 to 65 mass %, more preferably, it is 45 to 60 mass %.

$SiO_2$: 3 to 25 Mass %

Since $SiO_2$ in the slag is an important element for ensuring optimum fluidity, 3 mass % is necessary. However, if $SiO_2$ is too high exceeding 25 mass %, it reacts with the components (Al, Mg, Ca) in the molten metal, and the lower limits of each element (Al: 0.001 mass %, Mg: 0.001 mass %, Ca: 0.0001 mass %) cannot be ensured. That is, the concentrations of these elements become lower such that Al: less than 0.001 mass %, Mg: less than 0.001 mass %, Ca: less than 0.0001 mass %. Furthermore, along with this, the oxygen concentration also increases beyond 0.0050 mass %. It should be noted that the $SiO_2$ concentration can be adjusted by adjusting the amount of charge of Si. As described, the $SiO_2$ concentration is specified to 3 to 25 mass %. Preferably, it is 4 to 23 mass %, and more preferably, it is 5 to 20 mass %.

MgO: 5 to 30 Mass %

MgO in the slag is an important element for controlling the concentration of the Mg concentration in the molten metal within the concentration range recited in the claims and controlling the non-metallic inclusions to a suitable composition for the present invention. Therefore, the lower limit is set to be 5 mass %. On the other hand, if the MgO concentration exceeds 30 mass %, the MgO concentration in the molten metal becomes excessively high, thereby leading to deterioration of hot workability and deterioration of the surface quality. Therefore, the upper limit of MgO concentration is set to be 30 mass %. Preferably, it is set to the range of 7 to 28 mass %, and more preferably, it is set to the range of 10 to 25 mass %. It should be noted that the MgO in the slag falls within a predetermined range when the dolomite bricks or magnesia chrome bricks used in AOD or VOD refining dissolve into the slag. Alternatively, waste bricks of dolomite bricks or magnesia chrome bricks may be added to control the concentration within a predetermined range.

$Al_2O_3$: 1 to 25 Mass %

If the $Al_2O_3$ concentration is high, deoxidation will not work sufficiently, and the oxygen concentration will increase beyond 0.0050 mass %. If it is too low, it will be difficult to control the inclusions to CaO—$Al_2O_3$-based. Therefore, the $Al_2O_3$ concentration is set to the range of 1 to 25 mass %. Preferably, it is 2 to 23 mass %, and more preferably, it is 3 to 20 mass %.

EXAMPLES

Next, examples will be explained to further clarify the structure and effects of the present invention, but the present invention is not limited to only the following examples. Raw materials such as pure nickel and pure nickel scrap were melted in an electric furnace with a capacity of 30 tons or 60 tons. After that, oxygen blowing (oxidation refining) was performed in an electric furnace, AOD and/or VOD to remove C, limestone and fluorite were added to generate CaO—SiO—AlO—MgO—F-based slag, pure Si and/or Al were added to perform Ni reduction, and then it was deoxidized. After that, desulfurization was promoted by further stirring with Ar. The AOD and the VOD were lined with magnesia chrome bricks. Thereafter, the molten metal was poured into a ladle, the temperature and the composition were adjusted, and slabs were produced by a continuous casting machine, or ingots were produced by ordinary ingot casting. Furthermore, the ingot was subjected to hot forging to produce a slab.

The surface of the produced slab was ground and hot rolled by heating at a temperature of 1050° C. to produce a 6 mm thick slab. After that, annealing and pickling were performed to remove surface scale. Finally, cold rolling was subjected to produce a thin plate with a thickness of 1 mm.

Table 1 shows the chemical composition of the obtained nickel alloy, the slag composition at the end of AOD or VOD refining, the composition of non-metallic inclusions, morphology and quality evaluation of non-metallic inclusions. The measurement method and evaluation method are as follows.

(1) Chemical Composition and Slag Composition of Nickel Alloy:

A quantitative analysis was performed using a fluorescent X-ray analyzer, and the oxygen concentration of the nickel ally was quantitatively analyzed using an inert gas impulse melting infrared absorption method.

(2) Composition of Non-Metallic Inclusions:

Immediately after start of casting, the sample collected in the tundish was mirror-polished, and inclusions with a size of 5 μm or more were randomly measured at 20 points using SEM/EDS.

(3) Number Ratio of $MgO \cdot Al_2O_3$ Inclusions and Total Number Ratio of CaO and CaO—MgO The number ratio was evaluated from the results of the measurement in (2) above.

(4) Surface Defect Evaluation

The surface of a thin plate with a thickness of 1 mm was visually observed, and the number of surface defects caused by non-metallic inclusions and hot workability was measured. Observing the entire length of the coil, if the number of surface defects due to non-metallic inclusions and hot workability is 2 or less in the length of 100 in, it was evaluated as A; if it was evaluated as 3 to 5, it was evaluated as B; if it was evaluated as 6 to 10, it was evaluated as C; and it was evaluated as D if 11 or more.

(5) Pit Evaluation

A test piece was taken from the thin plate with a thickness of 1 mm in (4) above, mirror finished, and held in an atmosphere with a humidity of 60% and a temperature of 40° C. for 24 hours, and then surface of the test piece is washed with water. After buffing to a depth of about 1 μm, the number of pits exceeding 10 μm in depth and 40 lain in diameter was measured on the surface of a 10 cm×10 cm test piece with a 3D laser microscope. If the number of pits was 0, it was evaluated as A, if it was 1 or 2, it was evaluated as B, if it was 3 to 5, it was evaluated as C, and if it was 6 or more, it was evaluated as D.

(6) Total Evaluation:

The surface defect evaluation and pit evaluation are scored as follows, and if the total score of the surface defect evaluation and pit evaluation was 6 points, it was evaluated as A, if it was 4 to 5 points, it was evaluated as B, if it was 3 points, it was evaluated as C, and if it was 2 points or less or the surface defect evaluation or pit evaluation was evaluated as D evaluation, it was evaluated as D.

Scoring of surface defect evaluation: A3 points, B 2 points, C 1 point, D 0 points Pit evaluation: A3 points, B 2 points, C 1 point, D 0 points

TABLE 1

| | | Chemical components (balance of inevitable impurities) mass % | | | | | | | | | |
|---|---|---|---|---|---|---|---|---|---|---|---|
| | | Ni | C | Si | Mn | S | Cu | Al | Ti | Fe | Mg |
| Invention Examples | 1 | 99.39 | 0.006 | 0.150 | 0.23 | 0.0004 | 0.00 | 0.057 | 0.001 | 0.08 | 0.008 |
| | 2 | 99.42 | 0.009 | 0.160 | 0.28 | 0.0002 | 0.00 | 0.013 | 0.001 | 0.06 | 0.008 |
| | 3 | 99.42 | 0.015 | 0.130 | 0.23 | 0.0003 | 0.00 | 0.060 | 0.000 | 0.05 | 0.006 |
| | 4 | 99.35 | 0.008 | 0.130 | 0.23 | 0.0004 | 0.00 | 0.096 | 0.002 | 0.08 | 0.016 |
| | 5 | 99.22 | 0.010 | 0.270 | 0.24 | 0.0003 | 0.00 | 0.095 | 0.002 | 0.12 | 0.026 |
| | 6 | 99.39 | 0.012 | 0.130 | 0.23 | 0.0003 | 0.00 | 0.054 | 0.052 | 0.09 | 0.007 |
| | 7 | 99.49 | 0.007 | 0.110 | 0.23 | 0.0002 | 0.01 | 0.010 | 0.001 | 0.11 | 0.0025 |
| | 8 | 99.42 | 0.011 | 0.073 | 0.26 | 0.0006 | 0.00 | 0.001 | 0.001 | 0.07 | 0.0014 |
| | 9 | 99.36 | 0.008 | 0.210 | 0.20 | 0.0004 | 0.00 | 0.063 | 0.001 | 0.12 | 0.022 |
| | 10 | 99.35 | 0.014 | 0.140 | 0.23 | 0.0027 | 0.00 | 0.072 | 0.001 | 0.10 | 0.008 |
| | 11 | 99.40 | 0.010 | 0.120 | 0.24 | 0.0004 | 0.00 | 0.091 | 0.001 | 0.09 | 0.006 |
| | 12 | 99.34 | 0.008 | 0.110 | 0.23 | 0.0004 | 0.00 | 0.061 | 0.001 | 0.15 | 0.029 |
| Comparative Example | 13 | 99.11 | 0.012 | (0.320) | 0.24 | 0.0002 | 0.00 | 0.028 | 0.001 | 0.09 | 0.028 |
| | 14 | 99.20 | 0.013 | 0.140 | 0.24 | 0.0005 | 0.00 | (0.14) | 0.001 | 0.2 | (0.042) |
| | 15 | 99.85 | 0.005 | (0.004) | 0.003 | 0.0055 | 0.00 | (0.0004) | 0.001 | 0.05 | (0.0008) |
| | 16 | 99.36 | 0.007 | 0.130 | 0.23 | 0.0004 | 0.00 | 0.056 | 0.001 | 0.11 | 0.028 |
| | 17 | 99.35 | 0.009 | 0.140 | 0.23 | 0.0004 | 0.00 | 0.069 | 0.001 | 0.1 | 0.004 |
| | 18 | 99.44 | 0.013 | 0.100 | 0.23 | 0.0021 | 0.00 | 0.041 | 0.001 | 0.09 | 0.01 |
| | 19 | 99.47 | 0.009 | 0.010 | 0.22 | 0.0042 | 0.00 | 0.001 | 0.001 | 0.09 | (0.0002) |
| | 20 | 99.22 | 0.016 | 0.280 | 0.24 | 0.0004 | 0.00 | 0.097 | 0.001 | 0.05 | 0.008 |
| | 21 | 99.41 | 0.013 | 0.130 | 0.21 | 0.0004 | 0.00 | 0.057 | 0.001 | 0.09 | (0.033) |
| | 22 | 99.38 | 0.008 | 0.140 | 0.24 | 0.0006 | 0.00 | 0.067 | 0.001 | 0.08 | 0.008 |

TABLE 1-continued

| | | Chemical components (balance of inevitable impurities) mass % | | | | | Slag composition mass % | | | | |
|---|---|---|---|---|---|---|---|---|---|---|---|
| | | Ca | N | O | B | Production process | CaO | $SiO_2$ | $Al_2O_3$ | MgO | F |
| Invention Examples | 1 | 0.0004 | 0.001 | 0.0010 | 0.0015 | EF-VOD-LF-CC | 54.3 | 6.1 | 19.0 | 15.4 | 5.2 |
| | 2 | 0.0003 | 0.002 | 0.0013 | 0.0014 | EF-VOD-LF-CC | 55.9 | 18.1 | 3.0 | 19.3 | 5.7 |
| | 3 | 0.0006 | 0.001 | 0.0007 | 0.0008 | EF-VOD-LF-CC | 54.1 | 5.2 | 17.5 | 14.8 | 8.4 |
| | 4 | 0.0005 | 0.001 | 0.0006 | 0.0008 | EF-VOD-LF-CC | 53.2 | 7.1 | 18.2 | 20.1 | 1.4 |
| | 5 | 0.0031 | 0.002 | 0.0001 | 0.0011 | EF-VOD-LF-CC | 66.1 | 7.2 | 9.9 | 13.2 | 3.6 |
| | 6 | 0.0003 | 0.006 | 0.0014 | 0.0006 | EF-VOD-LF-IC | 57.7 | 8.0 | 10.7 | 21.3 | 2.3 |
| | 7 | 0.0001 | 0.001 | 0.0032 | 0.0008 | EF-AOD-LF-CC | 38.0 | 9.2 | 22.0 | 29.1 | 1.7 |
| | 8 | 0.0004 | 0.001 | 0.0043 | 0.0008 | EF-VOD-LF-CC | 46.7 | 24.1 | 1.3 | 23.4 | 4.5 |
| | 9 | 0.0022 | 0.001 | 0.0012 | 0.0016 | EF-VOD-LF-IC | 62.3 | 8.2 | 11.1 | 16.2 | 2.2 |
| | 10 | 0.0005 | 0.001 | 0.0015 | 0.0001 | EF-VOD-LF-CC | 41.2 | 12.8 | 21.4 | 18.2 | 6.4 |
| | 11 | 0.0003 | 0.001 | 0.0013 | 0.0013 | EF-VOD-LF-CC | 41.5 | 9.5 | 24.2 | 18.5 | 6.3 |
| | 12 | 0.0006 | 0.001 | 0.0016 | 0.0007 | EF-VOD-LF-CC | 50.2 | 5.2 | 18.3 | 22.1 | 4.2 |
| Comparative Example | 13 | (0.0061) | 0.001 | 0.0001 | 0.0008 | EF-VOD-LF-CC | 60.6 | 18.5 | 3.3 | 14.7 | 2.9 |
| | 14 | 0.0041 | 0.001 | (0.00008) | 0.0005 | EF-AOD-VOD-LF-CC | 52.1 | 4.1 | 22.1 | 13.9 | 7.8 |
| | 15 | (0.0000) | 0.001 | (0.0078) | 0.0004 | EF-VOD-LF-CC | (34.5) | (30.2) | (0.8) | 26.1 | 8.4 |
| | 16 | 0.0004 | 0.002 | 0.0031 | 0.0012 | EF-VOD-LF-CC | 39.2 | 5.7 | 24.1 | 21.2 | 9.8 |
| | 17 | (0.0058) | 0.001 | 0.0014 | 0.0014 | EF-VOD-LF-IC | 55.5 | 6.9 | 13.6 | 19.1 | 5.0 |
| | 18 | 0.0003 | 0.001 | 0.0009 | (0.0000) | EF-VOD-LF-CC | 39.1 | 11.1 | 17.5 | 23.2 | 9.1 |
| | 19 | (0.0000) | 0.001 | 0.0049 | 0.0002 | EF-VOD-LF-CC | 50.2 | 4.1 | (27.8) | 12.2 | 5.7 |
| | 20 | (0.0054) | 0.001 | 0.0001 | 0.0001 | EF-VOD-LF-CC | (73.1) | (2.1) | 6.2 | 10.1 | 8.5 |
| | 21 | 0.0005 | 0.001 | 0.0012 | 0.0001 | EF-VOD-LF-CC | 52.1 | 5.2 | 7.1 | (33.2) | 2.4 |
| | 22 | 0.0005 | 0.001 | 0.0006 | (0.0180) | EF-VOD-LF-CC | 51.1 | 8.5 | 12.9 | 21.1 | 6.4 |

TABLE 2

| | | Inclusion composition (mass %) 20-point analysis with EDS | | | | | | | | | | | | | | |
|---|---|---|---|---|---|---|---|---|---|---|---|---|---|---|---|---|
| | | MgO | | $MgO \bullet Al_2O_3$-base | | | $CaO-Al_2O_3$-base | | | | | $CaO-SiO_2$-base | | | | |
| | | n | MgO | n | MgO | $Al_2O_3$ | n | CaO | $Al_2O_3$ | $SiO_2$ | MgO | n | CaO | $SiO_2$ | $Al_2O_3$ | MgO |
| Invention Examples | 1 | 15 | 100 | | | | 5 | 45.1 | 53.3 | 0.3 | 1.3 | | | | | |
| | 2 | 17 | 100 | | | | | | | | | 3 | 50.1 | 48.2 | 0.8 | 0.9 |
| | 3 | 12 | 100 | | | | 8 | 45.3 | 54.1 | 0.1 | 0.5 | | | | | |
| | 4 | 18 | 100 | | | | 2 | 44.1 | 55.2 | 0.6 | 0.1 | | | | | |
| | 5 | 4 | 100 | | | | | | | | | | | | | |
| | 6 | 13 | 100 | 2 | 32.1 | 67.9 | 6 | 39.2 | 48.6 | 3.1 | 9.1 | | | | | |
| | 7 | | | 10 | 29.8 | 70.2 | 10 | 30.1 | 69.2 | 0.1 | 0.6 | | | | | |
| | 8 | | | | | | | | | | | 20 | 33.2 | 65.5 | 0.2 | 1.1 |
| | 9 | 7 | 100 | | | | 7 | 42.1 | 55.8 | 0 | 2.1 | | | | | |
| | 10 | 10 | 100 | | | | 10 | 38.2 | 56.2 | 3.7 | 1.9 | | | | | |
| | 11 | | | 7 | 9.5 | 90.5 | 13 | 30.2 | 68.7 | 0.4 | 0.7 | | | | | |
| | 12 | 16 | 100 | 4 | 45.2 | 54.8 | | | | | | | | | | |
| Comparative Example | 13 | | | | | | | | | | | | | | | |
| | 14 | 3 | 100 | | | | | | | | | | | | | |
| | 15 | | | | | | | | | | | 20 | 30.2 | 68.8 | 0.1 | 0.9 |
| | 16 | 4 | 100 | 16 | 33.3 | 66.7 | | | | | | | | | | |
| | 17 | | | | | | | | | | | | | | | |
| | 18 | 5 | 100 | 3 | 32.9 | 67.1 | 12 | 38.5 | 59.1 | 1.7 | 0.7 | | | | | |
| | 19 | | | | | | | | | | | | | | | |
| | 20 | | | | | | | | | | | 2 | 69.2 | 28.7 | 1.7 | 0.4 |
| | 21 | 11 | 100 | | | | | | | | | | | | | |
| | 22 | 5 | 100 | | | | 15 | 41.2 | 57.8 | 0.4 | 0.6 | | | | | |

| | | Inclusion composition (mass %) 20-point analysis with EDS | | | | | | | | | | | | | | |
|---|---|---|---|---|---|---|---|---|---|---|---|---|---|---|---|---|
| | | CaO-MgO-base | | | CaO | | $Al_2O_3$ | | Total of CaO and CaO-MgO Number ratio | $MgO \bullet Al_2O_3$ Number ratio | Observed inclusions other than oxid- | Number ratio of surface | Surface defect evalu- | Number of | Pit evalu- | Total evalu- |
| | | n | CaO | MgO | n | CaO | n | $Al_2O_3$ | (%) | (%) | base | defect | ation | pits | ation | ation |
| Invention Examples | 1 | | | | | | | | 0 | 0 | — | 1 | A | 0 | A | A |
| | 2 | | | | | | | | 0 | 0 | — | 0 | A | 0 | A | A |
| | 3 | | | | | | | | 0 | 0 | — | 0 | A | 0 | A | A |
| | 4 | | | | | | | | 0 | 0 | — | 0 | A | 0 | A | A |
| | 5 | 8 | 49.2 | 50.8 | 8 | 100 | | | 80 | 0 | — | 4 | B | 5 | C | C |
| | 6 | | | | | | | | 0 | 10 | TiN | 6 | C | 0 | A | B |
| | 7 | | | | | | | | 0 | 50 | — | 10 | C | 0 | A | B |

TABLE 2-continued

| | | | | | | | | | | | | | | | | |
|---|---|---|---|---|---|---|---|---|---|---|---|---|---|---|---|---|
| | 8 | | | | | | | | 0 | 0 | — | 6 | C | 0 | A | B |
| | 9 | 5 | 31.2 | 68.8 | 1 | 100 | | | 30 | 0 | — | 2 | A | 2 | B | B |
| | 10 | | | | | | | | 0 | 0 | — | 5 | B | 0 | A | B |
| | 11 | | | | | | | | 0 | 35 | — | 8 | C | 0 | A | B |
| | 12 | | | | | | | | 0 | 20 | — | 4 | B | 0 | A | B |
| Comparative Example | 13 | 4 | 76.2 | 23.8 | 16 | 100 | | | 100 | 0 | — | 7 | C | 12 | D | D |
| | 14 | 17 | 33.5 | 66.5 | | | | | 85 | 0 | — | 19 | D | 9 | D | D |
| | 15 | | | | | | | | 0 | 0 | — | 35 | D | 0 | A | D |
| | 16 | | | | | | | | 0 | (80) | — | 31 | D | 0 | A | D |
| | 17 | | | | 20 | 100 | | | 100 | 0 | — | 3 | B | 17 | D | D |
| | 18 | | | | | | | | 0 | 15 | — | 12 | D | 0 | A | D |
| | 19 | | | | | | 20 | 100 | 0 | 0 | — | 38 | D | 0 | A | D |
| | 20 | | | | 18 | 100 | | | 90 | 0 | — | 3 | B | 13 | D | D |
| | 21 | 9 | 22.4 | 77.6 | | | | | 45 | 0 | — | 16 | D | 2 | B | D |
| | 22 | | | | | | | | 0 | 0 | — | 9 | C | 5 | C | D |

Since Invention Examples 1 to 12 satisfied the range of the invention, they had few surface defects and few coarse pits exceeding 10 μm in depth and 40 μm in diameter on the sample surface, and good quality was obtained. Since invention examples 1 to 4 were in a preferable range, the surface defect evaluation and the pit evaluation were as good as A, and the total evaluation was also A.

In Invention Example 5, since the Al concentration was high at 0.095 mass % and Si concentration was high at 0.27 mass %, a large amount of Ca and Mg was supplied to the molten metal, and a large amount of CaO and CaO—MgO-based oxides were generated, the total number ratio of CaO and CaO—MgO-based oxides increased to number 80%. Five coarse pits were observed, and the pit evaluation was C. Furthermore, the Mg concentration was high at 0.026 mass %, the hot workability was deteriorated, and the surface defect evaluation was also B.

In Invention Example 6, since the Ti concentration was high at 0.052 mass % and the N concentration was high at 0.006 mass %, TiN was generated, surface defects caused by TiN were generated, and surface defect evaluation was C.

In Invention Example 7, since the Ca concentration was low at 0.0001 mass %, the number ratio of $MgO \cdot Al_2O_3$ inclusions was high at number 50%. Therefore, surface defects caused by $MgO \cdot Al_2O_3$ inclusions were generated, and the surface defect evaluation was C.

In Invention Example 8, since the Al concentration was low at 0.001 mass %, the deoxidation was insufficient and the O concentration was high at 0.0043 mass %. Therefore, the number of non-metallic inclusions increased, surface defects caused by inclusions occurred, and the surface defect evaluation was C.

In Invention Example 9, since the Ca concentration was high at 0.0022 mass % and the Mg concentration was high at 0.0022 mass %, CaO—MgO inclusions were formed. As a result, pits were generated, and the pit evaluation was B.

In Invention Example 10, since the B concentration was low at 0.0001 mass % and the S concentration was high at 0.0027 mass %, surface defects caused by hot workability were generated, the surface defect evaluation was B.

In Invention Example 11, since Al was added just before the end of refining, the Al concentration was high at 0.0091 mass %, but since the reaction time with slag was short, the Mg concentration was 0.006 mass %, and the Ca concentration was 0.0003 mass %, which were in a preferred range. As a result, the $Al_2O_3$ concentration in the formed $MgO \cdot Al_2O_3$ inclusions was high at 90.5 mass %, it exhibited behavior like to $Al_2O_3$, and caused surface defects caused by the inclusions, and the surface defect evaluation was C.

In Invention Example 12, Mg was directly added, resulting in a high MgO concentration of 0.029 mass % and high MgO concentration of 45.2 mass % in the produced $MgO \cdot Al_2O_3$. This lowered the melting point, promoted clustering, and caused surface defects due to inclusions. As a result, the surface defect evaluation was B.

Although the Invention Examples 5 to 12 were within the range of the invention, since the molten metal composition was not within the preferable range, surface defects and pits were generated, although they were in the allowable range, and the total evaluation was B or C.

On the other hand, the comparative examples were outside the range of the present invention. Each comparative example will be explained.

In Comparative Example 13, since the Si concentration was high at 0.320 mass %, and as a result of excessive deoxidation reaction, Ca and Mg were excessively supplied to the molten metal from the slag phase, the Ca concentration was high at 0.0061 mass % and the Mg concentration was high at 0.028 mass %. As a result, many non-metallic inclusions of CaO and CaO—MgO-based oxides were formed, and many pits exceeding 10 μm in depth and 40 lam in diameter were observed in pit evaluation. Furthermore, the Mg concentration was high, and surface defects due to hot workability were also observed.

In Comparative Example 14, since the Al concentration was high at 0.14 mass %, the deoxidation reaction excessively proceeded, and the O concentration was low at 0.00008 mass %. Ca and Mg were excessively supplied to the molten metal from the slag phase, thereby increasing the Ca concentration to 0.0041 mass % and the Mg concentration to 0.042 mass %. As a result, the hot workability was deteriorated and many surface defects caused by hot workability were generated in the final product. In addition, many coarse pits due to CaO—MgO-based oxides were also observed.

In Comparative Example 15, due to the effect of a large amount of residual slag attached to the refractories, the CaO concentration in the slag was low at 34.5 mass %, the $Al_2O_3$ was low at 0.8 mass %, and the $SiO_2$ concentration was high at 30.2 mass %. As a result, the Si concentration was 0.004 mass % and the Al concentration was 0.0004 mass %, that were low, and deoxidation did not progress, thereby resulting in an O concentration as high as 0.0078 mass %. As a result, the number of non-metallic inclusions increased and many surface defects caused by the inclusions occurred.

In Comparative Example 16, when Mg was added just before the end of refining, it reacted with $Al_2O_3$ in the slag, thereby generating many $MgO \cdot Al_2O_3$ inclusions. As a result, deposition on the immersion nozzle occurred, and many surface defects were generated.

In Comparative Example 17, when Ca was added just before the end of refining, the yield was higher than expected, and the Ca concentration was high at mass %. As a result, many CaO inclusions were formed and coarse pits were also observed.

In Comparative Example 18, no B was added, and the B concentration was 0.0000 mass %, which was below the analysis limit. As a result, the hot workability was deteriorated, and many surface defects due to hot workability were observed in the final product.

In Comparative Example 19, the added Al came into direct contact with the slag, was not retained in the molten metal, became an oxide, and the $Al_2O_3$ concentration in the slag was high at 27.8 mass %. Furthermore, since the Mg concentration and the Ca concentration in the molten metal became low, non-metallic inclusions of $Al_2O_3$ alone were formed, thereby resulting in a large number of defects on the surface of the final product.

Comparative Example 20 was one in which lime was excessively added, and the CaO concentration in the slag was high at 73.1 mass %, and the $SiO_2$ concentration was low at 2.1 mass %. As a result, the CaO activity in the slag increased, excessive Ca was supplied to the molten metal, the Ca concentration increased to 0.0054 mass %, many CaO inclusions were formed, and coarse pits were observed.

In Comparative Example 21, since the refractory was severely eroded, the MgO concentration in the slag was high at 33.2 mass %, Mg was excessively supplied to the molten metal, and the Mg concentration was high at 0.033 mass %. As a result, the hot workability was remarkably deteriorated, and a large number of surface defects due to the hot workability were generated in the final product.

Comparative Example 22 had a high B concentration of 0.0180 mass % due to the excessive addition of B. As a result, since coarse borides were formed, workability and corrosion resistance were deteriorated, and many large surface defects due to hot workability were generated.

The invention claimed is:

1. A nickel alloy consisting of, by mass %, Ni: 99.0% or more, C: 0.020% or less, Si: 0.01 to 0.3%, Mn: 0.3% or less, S: 0.010% or less, Cu: 0.2% or less, Al: 0.001 to 0.1%, Fe: 0.4% or less, O: 0.0001 to 0.0050% or less, Mg: 0.001 to 0.030%, Ca: 0.0001 to 0.0050%, B: 0.0001 to 0.0016%, and balance of inevitable impurities; the alloy comprising non-metallic inclusions, wherein the non-metallic inclusions comprise one or more of MgO, CaO, CaO—$Al_2O_3$-based oxides, CaO—$SiO_2$-based oxides, CaO—MgO-based oxides, and $MgO{\cdot}Al_2O_3$, and the $MgO{\cdot}Al_2O_3$ is present at a number ratio of 50% or less with respect to all oxide-based, non-metallic inclusions.

2. A nickel alloy consisting of, by mass %, Ni: 99.0% or more, C: 0.020% or less, Si: 0.01 to 0.3%, Mn: 0.3% or less, S: 0.010% or less, Cu: 0.2% or less, Al: 0.001 to 0.1%, Fe: 0.4% or less, O: 0.0001 to 0.0050% or less, Mg: 0.001 to 0.030%, Ca: 0.0001 to 0.0050%, B: 0.0001 to 0.0016%, 0.05 mass % or less of Ti and 0.005 mass % or less of N, and balance of inevitable impurities;

the alloy comprising non-metallic inclusions, wherein the non-metallic inclusions comprise one or more of MgO, CaO, CaO—$Al_2O_3$-based oxides, CaO—$SiO_2$-based oxides, CaO—MgO-based oxides, and $MgO{\cdot}Al_2O_3$, wherein the $MgO{\cdot}Al_2O_3$ is present at a number ratio of 50% or less with respect to all oxide-based, non-metallic inclusions.

3. The Ni alloy according to claim 1, wherein in the non-metallic inclusions, the $MgO{\cdot}Al_2O_3$ includes 10 to 40 mass % of MgO and 60 to 90 mass % of $Al_2O_3$, the CaO—$Al_2O_3$-based oxides include 30 to 70 mass % of CaO and 30 to 70 mass % of $Al_2O_3$, the CaO—$SiO_2$-based oxides include 30 to 70 mass % of CaO and 30 to 70 mass % of $SiO_2$, and the CaO—MgO-based oxides include 20 to 80 mass % of CaO and 20 to 80 mass % of MgO.

4. The Ni alloy according to claim 1, wherein in the non-metallic inclusions, the number ratio of the total number of the CaO and the CaO-based oxides is 75% or less.

5. A method of producing the nickel alloy according to claim 1, the method comprising:

melting a raw material in an electric furnace, decarburizing the raw material in an electric furnace, by at least one technique selected from AOD (argon oxygen decarburization) and VOD (vacuum oxygen decarburization), charging lime, fluorite, and at least one of Si and Al, deoxidizing and desulfurizing while stirring using slag consisting of CaO: 35 to 70 mass %, SiO2:3 to 25 mass %, MgO: 5 to 30 mass %, $Al_2O_3$: 1 to 25 mass %, and balance of F and inevitable impurities, after adjusting the temperature and composition while promoting the floating of inclusions by Ar stirring in a ladle furnace, producing a slab or ingot by a continuous casting machine or ingot casting, hot forging the ingot, thereby producing a slab, and at least one of (i) continuously hot rolling and (ii) continuously cold rolling the ingot or slab, thereby obtaining a nickel alloy.

* * * * *